United States Patent [19]

Cordisco

[11] Patent Number: 5,071,047

[45] Date of Patent: Dec. 10, 1991

[54] BABY CARRIER

[76] Inventor: Claire Cordisco, 425 Storms Rd., Valley Cottage, N.Y. 10989

[21] Appl. No.: 532,854

[22] Filed: Jun. 4, 1990

[51] Int. Cl.[5] ..... A61G 1/00

[52] U.S. Cl. ..... 224/158; 224/159; 224/160

[58] Field of Search ..... 224/158, 159, 160, 151, 224/153, 156, 209

[56] References Cited

U.S. PATENT DOCUMENTS

| | | | |
|---|---|---|---|
| 921,812 | 5/1909 | Dorf | 224/209 |
| 2,554,340 | 7/1949 | Maxwell | 224/160 |
| 3,013,282 | 12/1961 | Volavsek | 5/82 |
| 3,587,952 | 6/1971 | Higuchi | 224/160 |
| 3,780,919 | 1/1972 | Hansson | 224/6 |
| 4,009,808 | 3/1977 | Sharp | 224/6 |
| 4,139,131 | 2/1979 | Hathaway | 224/160 |
| 4,166,558 | 9/1979 | Schroeder | 224/158 |
| 4,390,116 | 6/1983 | Fehr | 224/209 |
| 4,402,440 | 9/1983 | Purtzer | 224/160 |
| 4,423,514 | 1/1984 | Elf | 224/151 |
| 4,467,945 | 8/1984 | Schaapveld | 224/160 |
| 4,492,326 | 1/1985 | Storm | 224/160 |
| 4,579,264 | 4/1986 | Napolitano | 224/160 |
| 4,724,987 | 2/1988 | Maheu | 224/159 |

FOREIGN PATENT DOCUMENTS 2026848 2/1980 United Kingdom .

*Primary Examiner*—Linda J. Sholl
*Assistant Examiner*—Antoine Gamarra
*Attorney, Agent, or Firm*—Stanley J. Yavner

[57] ABSTRACT

A baby carrier having upper and lower ends and capable of assuming multiple positions in use in carrying an infant. The upper portion includes an opening for a pillow or the like to provide comfort to the baby and a number of accessories are provided to enable position alteration for the baby carrier. A crotch slide separates the upper and lower ends of the item, a strip separator is used to accommodate the various positions of the baby carrier and snap hooks are used to attach the lowermost extent of the lower end strips to the upper end of the baby carrier.

7 Claims, 3 Drawing Sheets

FIG. 1
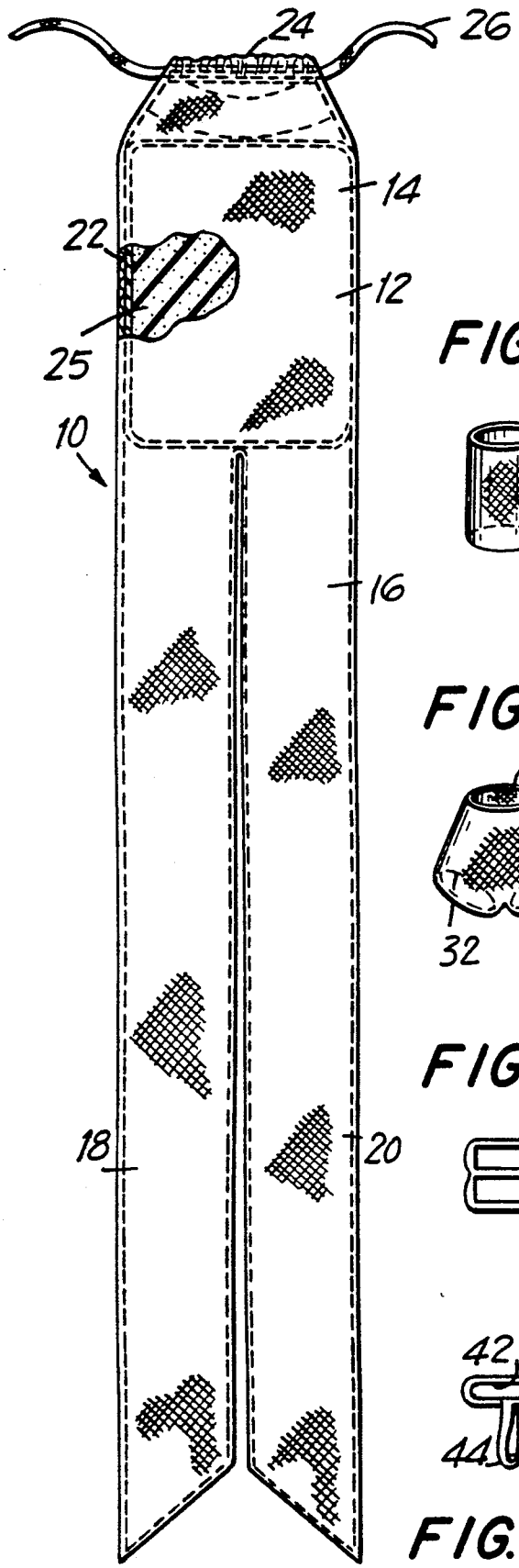
FIG. 2
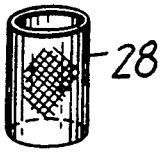
FIG. 3
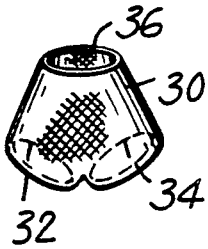
FIG. 4
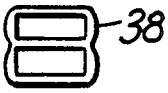
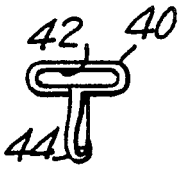
FIG. 5
FIG. 6
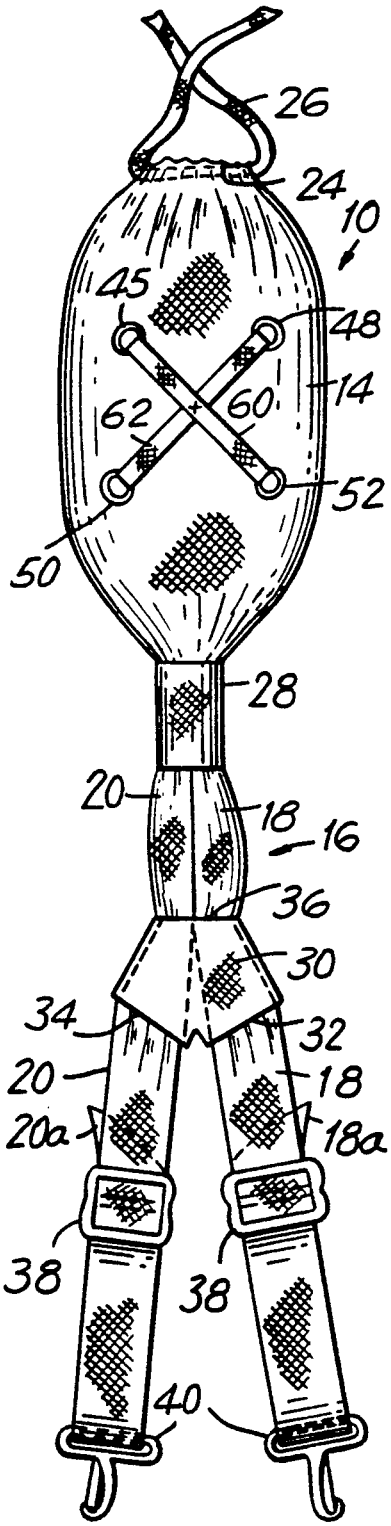

BABY CARRIER

FIELD OF THE INVENTION

This invention relates primarily to baby carriers, and more particularly to a baby carrier capable of assuming different carrying positions in a convenient and comfortable manner.

DESCRIPTION OF THE PRIOR ART AND BACKGROUND OF THE INVENTION

Baby carriers have become extremely popular with parents during the past few years. During this period, a number of manufacturers have entered the field with products which facilitate carrying of an infant in one or two positions, such as on the parent's back, on the parent's front (upright position for the infant), or in a supine front position. Most of these prior art carriers are not capable of assuming more than one or two positions, and if they are capable of assuming a front supine position for the infant, are not particularly comfortable. Specifically, Elf U.S. Pat. No. 4,428,513 shows, in FIG. 12, only one shoulder bearing the weight of the infant on the carrying parent. The infant's head, in that drawing, is curled tightly due to the child's weight against the carrying parent's body. Likewise, Schroeder U.S. Pat. No. 4,166,558 shows the infant's head pulled inwardly toward the carrying parent's weight-bearing shoulder strap. Furthermore, most do not evenly distribute the weight of the infant on the wearer's body.

Also, some manufacturers have attempted to use stiffening, plastic inserts to baby carriers for purposes of structuring the infant's posture especially in the supine position.

SUMMARY OF THE INVENTION

Accordingly, a primary object of the present invention is to provide a convenient, comfortable and infant weight-distributing baby carrier, which is capable of efficiently assuming various carrying positions.

A further, and more particular object, of the present invention is to provide a baby carrier which is safe and comfortable for the wearer and for the infant being carried.

These and other objects of the present invention are accomplished in a baby carrier which features an elongated piece of material, terminating at a first end in a combination foam and relatively stiff plastic filled pouch, tied through a casing to gather the end at its uppermost extremity. The second end of the baby carrier material is bifurcated into two strips of material. A crotch slide is provided at the juncture of the first and second ends of the baby carrier material. A strip separator is provided at the mid-portion of the second end. Slide guides are provided near the lowermost portion of the second end, with one slide guide being positioned on each bifurcated strip. At the extreme lowermost end, snap hooks are secured in order to attach to D-rings arranged on the filled upper portion of the baby carrier.

The baby carrier of the present invention is provided to assume at least three positions, with respect to the carrying parent: the first position is supine for the baby, with firm and padded support for the head, neck and upper body of the infant; the second position is with the baby vertical and upright in front of the carrying parent; and the third position is with the baby vertical and upright in the back of the carrying parent.

In the first position, the crotch slide is in its uppermost position, freely adjusted to be between the legs of the infant, its placement determined by the length of the child (closer to the first end filled pouch), the strip separator is positioned in approximately the center of the carrying parent's back, one bifurcated strip is draped over the carrying parent's right shoulder and the other strip is over the other carrying parent's left shoulder, with one respective snap hook being attached at the lower left (baby's left) D-ring on the back of the filled first end, and the other snap hook being attached to the upper right (baby's right D-ring on the back of the filled first end).

In the second position, the ties that gather the uppermost end are untied. The gathered material is released and spread out. The soft, foam filled upper section is folded inwardly (about 4") to form a neck pillow for the child. The crotch slide is adjusted to be between the legs of the child, and the strap separator is slidably moved to a position over the crotch slide, and therefore out of operating position. Each strip or strap is over a shoulder and crossed at the back of the carrying parent, and the slide guides and snap hooks are at their lowermost positions, adjusted as determined by the size of the carrying parent and the size of the child. The snap hooks are attached to the left and right upper (baby's upper) D-rings on the filled first end. It should be understood that the upper end filling includes a relatively stiff plastic portion and a foam portion which extends about 4" upwardly and beyond the relatively stiff filling.

In the third position, the same positions are assumed by the parts of the baby carrier, as with the second position, but the filled first end is to the rear of the carrying parent. The straps or strips do not need to be crossed over the front of the carrying parent, but can be over each shoulder in a "back-pack" style.

In all three positions, the straps or strips on the carrying parent's shoulders are spread to their fullest extent in order to evenly and comfortably distribute the baby's weight.

BRIEF DESCRIPTION OF THE DRAWINGS

Other objects, features and advantages of the present invention will become apparent by the following more detailed description of the present embodiment, illustrating the present invention with reference to the accompanying drawings, wherein:

FIG. 1 is a partial sectional view of the baby carrier of the present invention, without accessory elements;

FIGS. 2–5 are drawings of the accessory elements, showing a crotch slide in FIG. 2, a strip separator in FIG. 3, a slide guide in FIG. 4 and a snap hook in FIG. 5;

FIG. 6 is a view similar to that of FIG. 1, but with accessories attached, and showing D-rings on the back portion of the filled, first end of the baby carrier;

DETAILED DESCRIPTION OF THE PREFERRED EMBODIMENT

Figure 8:
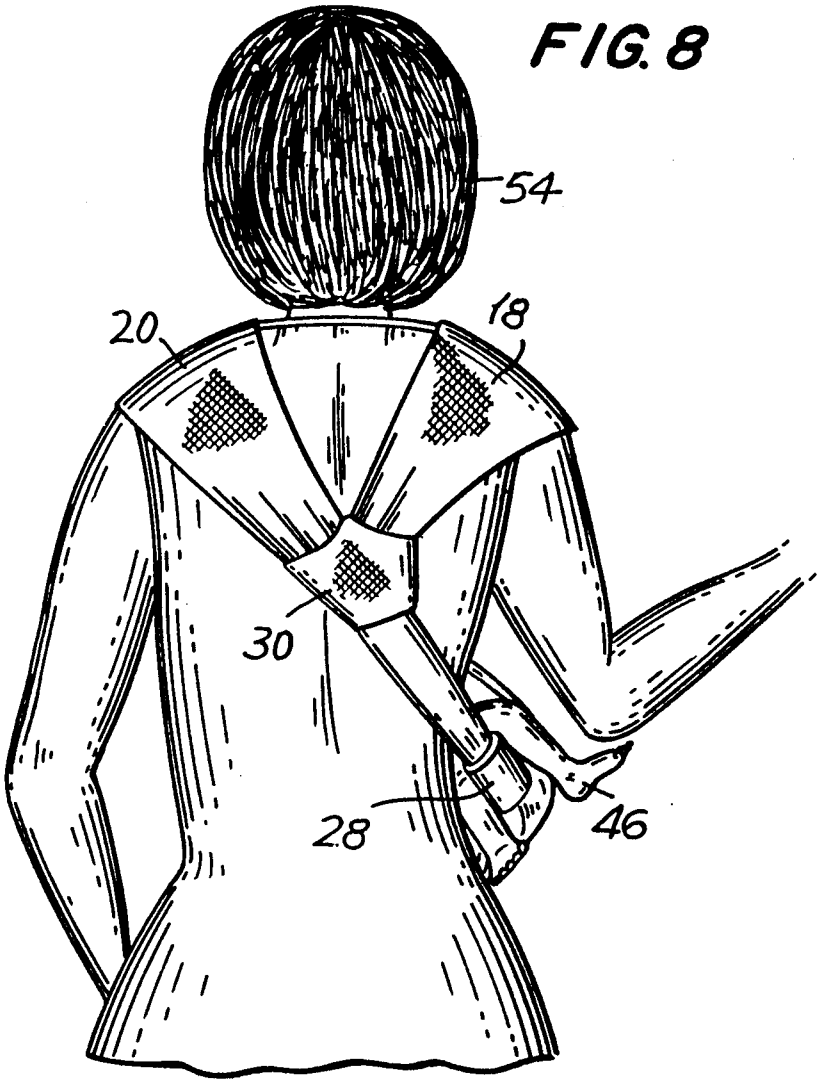
FIGS. 7 and 8 are, respectively, front and back views of the first, supine position for the baby, showing the position of the elements and accessories of the baby carrier in that position.

The baby carrier, generally designated 10, of the present invention is formed of an elongated piece of fabric 12, including an upper end portion 14 and a lower end portion 16. Lower end portion 16 includes bifurcated strips 18, 10, and upper end portion 14 is formed into a sack, or the like, 22, with a gathered uppermost extremity 24, through which rope 26 is threaded.

Various accessories are used with the baby carrier in order to form baby carrier material 12 into an article useful according to the present invention. Such accessories are shown in FIGS. 2–5, wherein a crotch slide 28 is shown. Inside sack 22 is placed a soft foam sheet, approximately ½" thick, and a relatively stiff polypropylene sheet, as may be seen from the partial section shown in FIG. 1.

Various accessories are used with the baby carrier in order to form baby carrier material 12 into an article useful according to the present invention. Such accessories are shown in FIGS. 2–5, wherein a crotch slide 28 is shown in FIG. 2 for gathering upper and lower ends, 14, 16, as determined by the length of the child and/or the choice of carrier position used, as well as to gather the material around pillow 25. Strip separator 30 of FIG. 3 is placed on the material, somewhat downward from crotch slide 28, when the carrier is being set up for the first or supine position, so that strips 18, 20, feed through openings 32, 34, respectively, as defined by strip separator 30. Likewise, strips 18, 20 both feed through opening 36, defined in the upper part of strip separator 30. When the carrier is being used for the front or back upright positions, strip separator 30 is placed over crotch slide 28, removing the strip separator from an operation orientation for the upright position.

Slide guide 38 is shown in FIG. 4 as a standard, double-opening strip slide guide. Snap hook 40 of FIG. 5 defines a strip opening 42 and a snap hook portion 44 for use in the baby carrier 10 of the present invention.

Use of such accessories, as well as D-rings 45, 48, 50 and 52 are shown in FIG. 6, with crotch slide 28 in place at the meeting point for upper end 14 and lower end, generally designated 16, having strips 18 and 20. Slightly downwardly from crotch slide 28 is strip separator 30, which maintains gathered strips 18 and 20 above it, by means of opening 36, and separates strips 18, 10 below it, by means of openings 32, 34.

Slide guides 38 are arranged near, but not at, the bottom-most end of strips 18 and 20, with such strips being doubled over through the openings 42 in snap hooks 40 and then up through slide guides 38, above which free ends **18*a* and 20*a* of strips 18, 20 can be observed in FIG. 6. In order to make the straps or strips even shorter for carring parents of short stature, the free ends 18*a*, 20*a* are doubled back toward snap hooks 40**.

Thus, various configurations of baby carrier 10 are assumed by manipulation of accessories 28, 30 and 38. For instance, a larger upper end portion 14 is formed by lowering crotch slide 28. Likewise, longer operationally free straps 18, 20 are formed by moving strip separator 30 upwardly. Lengthening (or shortening) of strips 18, 20 is also accomplished by moving slide guides 38 downwardly, (or upwardly) without disturbing the relationship between ends **18*a*, 20*a* and slide guides 38. By pulling such ends 18*a*, 20*a* further through slide guides 38, the overall functional lengths of strips 18, 20** are decreased.

Rope 26 is used to gather the casing of material 24, in order to form a contoured area to cradle the infant's head when the carrier is used for the supine position. The rope is untied, the gathers released and spread out, and the upper foam section of pillow 25 folded down and inwardly for upright positions.

Figure 7:
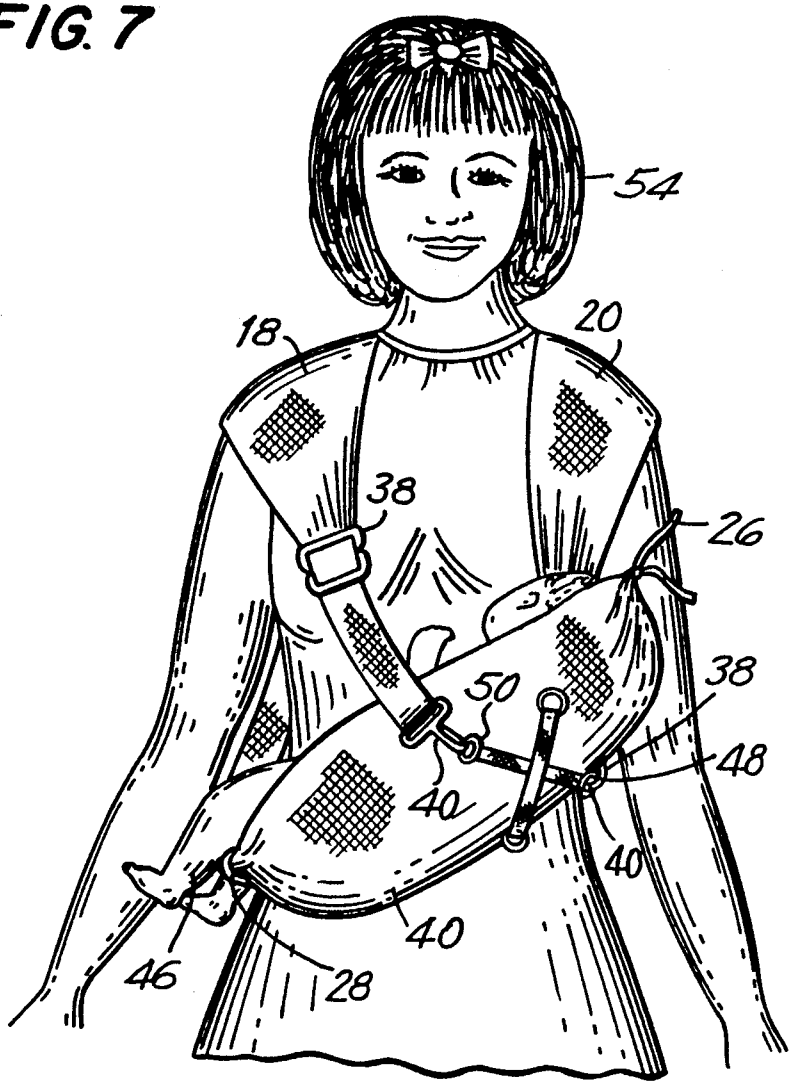

FIGS. 7 and 8 show a first position for use of baby carrier 10, wherein rope 26 is tied to enclose a pillow 25 within upper end 14 of baby carrier 10, as previously described. Slide guides 38 and strip separator 30 are positioned as shown in order to create a supine position for baby 46. Likewise, in FIGS. 7 and 8 crotch slide 28 is shown positioned approximately near the area between the legs of baby 46. Particularly, strip separator 30 is adjusted to a position at the carrying parent's middle to upper back in order to prevent the carrying parent's shoulder strap from slipping off of that shoulder. Snap hooks 40 attach to D-rings 50, 48, as shown. It may be seen that this creates a comfortable position for both the carrying parent 54 of the baby 46, with strip separator 30 in approximately the center of the carrying parent's back. One slide guide is approximately over the right breast of the carrying parent 54, with the other slide guide being somewhat downwardly below the left breast of the carrying parent and the crotch slide 28 being between the baby's legs, thus serving as a restriction for baby 46 against undesired slipping of the baby from the carrier. At the same time, baby 46 is in a flexible and yet cushioning under-support as enabled by pillow 25 within upper end 14 of the baby carrier.

Figure 9:
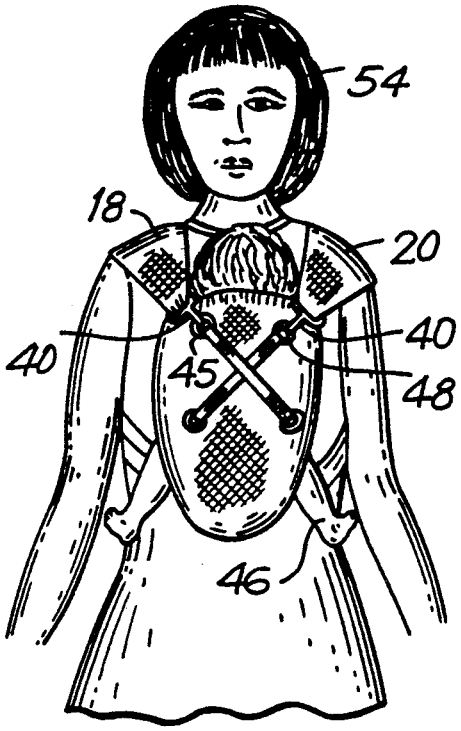
FIGS. 9, 10 and 11 are, respectively, front, back and side views showing the baby carrier in the second or upright, front position for the baby.
Figure 10:
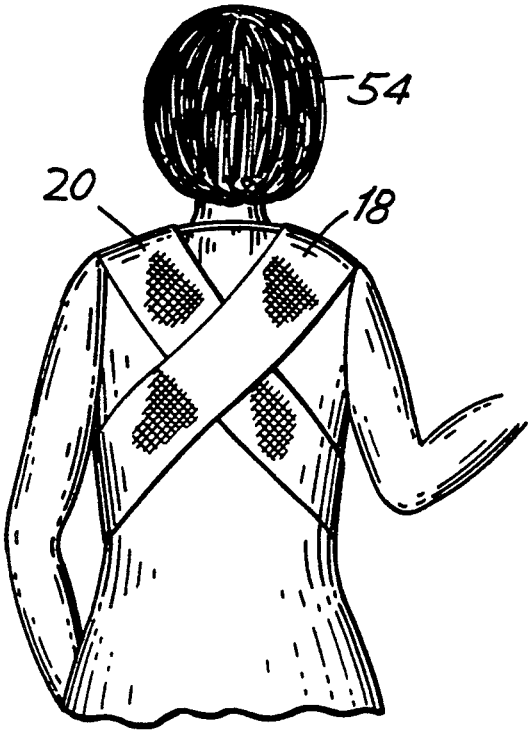
Figure 11:
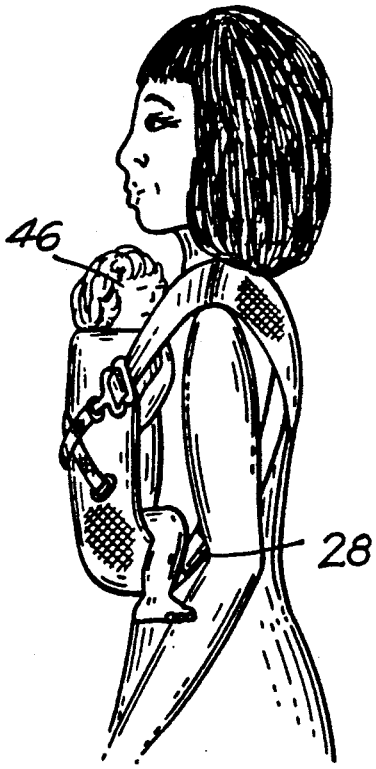

In the same manner, FIGS. 9–11 show a second position for baby 46, wherein the top rope is untied and the gathers of the material released. The upper part of the foam filling in the upper end section is folded inwardly toward the baby's neck, to form a neck-supportive pillow. Crotch slide 28 and strip separator 30 are placed between the legs of baby 46, snap hooks 40 are attached to D-rings 45, 48 and strip separator (not shown) is in its uppermost position, almost abutting or covering crotch slide 28. This gives a wide separation and a wide spread to strips 18, 20, particularly at the shoulders of carrying parent 54. In this upward, front position for baby 46, either slide guides 38 can be removed and the ends of strips 18, 20 tied off in or through the openings 42 of snap guides 40, or the slide guides 38 are placed to almost abut snap hooks 40 near the baby 46.

Figure 12:
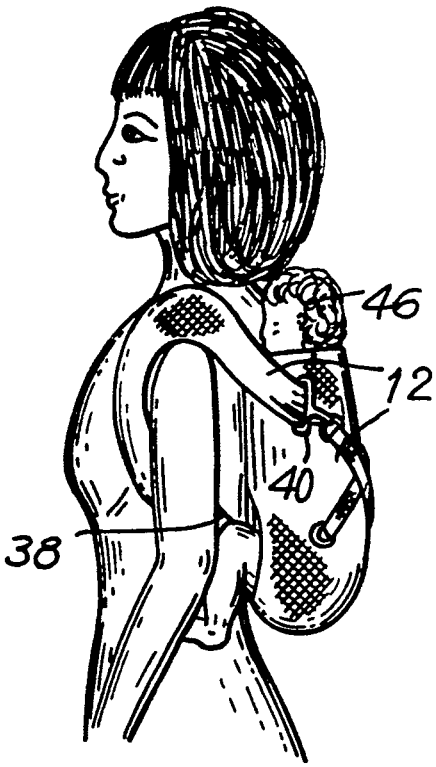
FIG. 12 is a side view showing the baby carrier and baby in the third position.

The third position is shown in FIG. 12 wherein baby 46 is upright and on the back of carrying parent 54. Basically, the arrangement of baby carrier material fabric 12 and accessories 40, etc. are as shown in FIGS. 9–11, but reversed on carrying parent 54 from the front upright position of baby 46, to the rear position. The strip or straps are shortened significantly in this position, according to the size of the parent. The slide guides are placed down, perhaps as far as the carrying parent's elbow. The free ends of the straps or strips may also be doubled back toward the snap hooks.

It should also be mentioned that D-rings 45, 48, 50 and 52 are held in position with a certain separation by means of crossed straps 60, 62 (FIG. 6), which are attached to upper end 14 and in turn are attached to the D-rings.

Accordingly, a comfortable and efficiently operable baby carrier is provided to satisfy the objectives of the present invention. Limitations are to be imposed only by the following claims:

What is claimed is:

1. A baby carrier for use by a carrying parent for carrying a baby constructed primarily of fabric material comprising an upper end encircling a pillow, a lower end formed of bifurcated strips, a movable crotch slide for encircling said strips in a position to adjust for the length of said baby and a strip separator for gathering said strips and for separating said strips, each strip terminating downwardly in a snap hook, each snap hook defining an opening through which the strip is attached, and a hook, said upper end having pairs of D-rings, through which said hooks are placed to attach the strips to said upper end around said carrying parent.

2. The invention according to claim 1, wherein said strips include slide guides for adjusting the length of said strips.

3. The invention according to claim 1, wherein said upper end includes straps extending between each pair of D-rings, to which said D-rings are attached, and which said straps are attached, in turn, to said material.

4. The invention according to claim 1, wherein said baby carrier assumes a first position with one of said strips over each shoulder of said carrying parent, a first of said strips being attached at its lowermost end to one of said D-rings and the lowermost end of the other of said strips being attached to another D-ring.

5. The invention according to claim 4, wherein a strap is provided to extend between said one attached D-ring and said other attached D-ring in order to prevent twisting of said upper end.

6. The invention according to claim 1, wherein said baby carrier assumes a position with said baby upright and in front of said carrying parent, and with said crotch slide being provided to encircle said strips between the legs of said baby.

7. The invention according to claim 1, wherein said baby carrier assumes a position with said baby upright and in back of said carrying parent, and with said crotch slide being provided to encircle said strips between the legs of said baby.

* * * * *